US005080926A

United States Patent [19]

Porter et al.

[11] Patent Number: 5,080,926

[45] Date of Patent: Jan. 14, 1992

[54] ANTI-FOULING COATING PROCESS

[76] Inventors: Julian Porter; Larry Suhl, both of 4674 Alvarado Cyn. Rd., San Diego, Calif. 92120

[21] Appl. No.: 578,582

[22] Filed: Feb. 9, 1984

[51] Int. Cl.[5] ..... B05D 1/08; B05D 3/12

[52] U.S. Cl. ..... 427/34; 422/6; 427/292; 427/419.2; 427/423

[58] Field of Search ..... 427/34, 292, 419.2, 427/423; 422/6

[56] References Cited

U.S. PATENT DOCUMENTS

| | | | |
|---|---|---|---|
| 3,877,961 | 4/1975 | Tank et al. | 427/203 X |
| 4,248,440 | 2/1981 | McCormick | 427/34 X |
| 4,457,948 | 7/1984 | Ruckle et al. | 427/34 |

FOREIGN PATENT DOCUMENTS

| | | | |
|---|---|---|---|
| 1003118 | 9/1965 | United Kingdom | 427/34 |

OTHER PUBLICATIONS

A. Akhtar: "Plasma Sprayed Coatings for Cavitation Protection in Hydraulic Turbines", *Materials Performance*, Aug. 1982, pp. 15-18.

Laque: *Marine Corrosion Causes and Prevention*, John Wiley & Sons, Inc., New York, 1975, pp. 233-246.

*Primary Examiner*—Richard D. Lovering

*Attorney, Agent, or Firm*—Henri J. A. Charmasson

[57] ABSTRACT

A mechanical process for preventing the fouling of metalic objects such as ship propellers, hulls and other types of hardware exposed to seawater by application on the exposed surface of a ceramic coating. The coating is applied by thermal spraying. The ceramic coating is formulated to have sufficient hardness to prevent encrustation of barnacles, tube worms and other parasites, but retains enough malleability to prevent brittleness and to provide sufficient resistance to impacts.

5 Claims, 1 Drawing Sheet

ANTI-FOULING COATING PROCESS

FIELD OF THE INVENTION

This invention relates to the construction and maintenance of marine hardware and to the use of marine paint and other protective coatings in order to prevent fouling by incrustation of marine life.

BACKGROUND OF THE INVENTION

The fouling of marine hardware, especially the fouling of hulls and propellers, due to the incrustation of barnacles, tube worms and other parasites is a process that has plagued shipowners since the first time man ventured upon the sea. In a large ship, the loss of speed and engine efficiency due to fouling is a major problem and the cause of costly periodic maintenance. After a few months in the water, a ship propulsion system loses from 10 to 20 per cent of its efficiency due to fouling. It has been estimated that 60 per cent of the loss is attributable to the fouling of propeller blades, and 40 per cent to the fouling of the hull. Marine engineers try to promote a smooth and rapid flow of water against the propeller blades for maximum efficiency. To this end, propellers are made of a durable and hard substance such as manganese bronze and the blade surfaces are highly polished. Barnacles and tube worms have the uncanny ability to attach themselves to such hard and polished surfaces by first depositing a speck of glutinous substance which provides a temporary bond, then to anchor themselves more permanently by digging into the surface material.

To this day, the most efficient anti-fouling method has been the use of copper coating and copper paints. As the copper reacts with the seawater, toxic salts are produced which kill the parasitic sea life. The use of copper or other anti-fouling toxic metals has a serious disadvantage, not the least of which is the polluting of anchoring sites by the toxic salts. Furthermore, copper coating or paint tends to react by electrolysis with other metals of the substrate in the salt water environment. This in turn accelerates the corrosion of the supporting hardware.

Various types of toxic and nontoxic coatings have been tried with little success. Teflon coating which maintains a low coefficient of friction and favorize a high rate of flow of the water against the propeller blades to wash away the parasites has shown some promise. However, since ships tend to spend long periods at the dock sites, barnacles find enough time to anchor themselves permanently to the propellers during these idle periods.

SUMMARY OF THE INVENTION

The principal purpose of this invention is to provide a coating process to be applied on the surface of marine hardware exposed to seawater which is hard enough to prevent crusteaceans from anchoring themselves to said surface.

A further object of this invention is to provide a nontoxic coating against the fouling of marine hardware which is free of adverse environmental impact.

It is also the object of this invention to provide a coating which will resist cavitation erosion, is easily repairable in case of mechanical damage and has galvanic compatability with the substrate and other adjacent surfaces.

These and other objects are achieved by means of the thermal spraying of the metalic substrate with a ceramic coating which provides a hard, smooth and inert surface finished to a high polish to minimize drag but remain ductile enough to minimize delamination, spalling and breaking away from mechanically damaged areas. The coating process can easily be incorporated into the propeller and marine hardware manufacturing processes, inventory storage, shipping, installation, maintenance and repair. It is nontoxic to the marine environment relying not on the chemical poisoning of the parasitic organisms, but on mechanical strength to prevent attachment.

DESCRIPTION OF THE PREFERRED EMBODIMENT OF THE INVENTION

Figure 1:
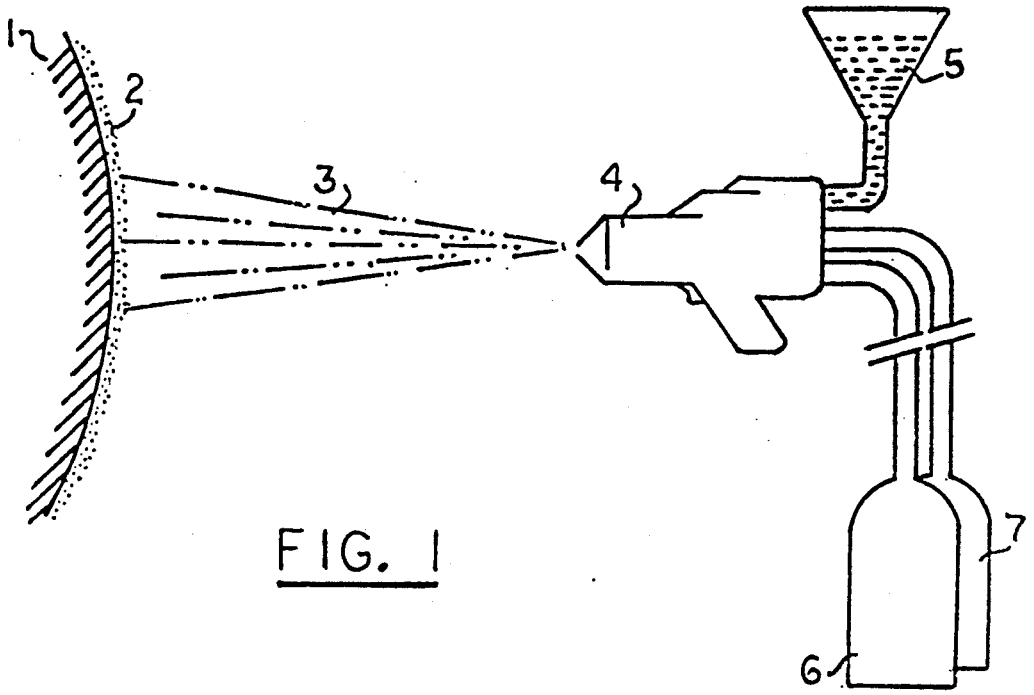
FIG. 1 is a diagramatical illustration of the coating process.

FIG. 1 illustrates the coating process of a section 1 of marine hardware such as a propeller blade which is constantly exposed to seawater and highly subject to incrustation by barnacles and other marine parasites. The substrate 1 to be sprayed does not have to be made from a particularly hard or non-corrosive material. While, for instance, manganese bronze is used currently in the manufacture of ship propellers, the disclosed coating process allows for the use of a softer and corrodible material such as steel.

The surface to be coated is prepared by blasting with a metalic grit at sufficient pressure to provide an anchoring tooth for the coating but not enough pressure to permit the grit to become entrapped in the substrate. An aluminum oxide grit is used, in lieu of the conventional chilled iron grit for this process. Aluminum oxide is a neutral material when used in blasting bronze substrates. Traces of iron remaining on the blasted surface would cause deleterious reactions with the substrate and/or the coating medium. The ceramic coating 2 is sprayed in a molten form 3 from a thermal spraying gun 4 held a short distance from the substrate 1. Thermal spraying consists of passing a powdered mixture of the spraying material from a reservoir 5 through a plasma created in the air gun 4 from gasses such as nitrogen and hydrogen drawn from containers 6 and 7. This method of thermal spraying is not novel and is well known to those skilled in the metallurgical arts.

The preferred coating material comprises refractory oxides such as the Alumina-Titania ($Al_2O_3TiO_2$) type 130 offered by Metco, Inc. of Westbury, Long Island, N.Y. The resultant coating is resistant to heat and to most acids and alkalies, and has a high electrical resistivity. We have discovered that this type of coating process yields a surface finish which has the right amount of density, hardness and smoothness to inhibit the incrustation of parasitic organisms in a saltwater environment; without sacrificing other desirable properties such as resistance to impact delamination, spalling and breaking away from mechanically damaged areas. Aluminum oxide (Alumina) the preferred refractory oxide, has a hardness, taken with a 100 gram load, of 9 mohs; and fused alumina may be as hard as 12 mohs, as compared to diamonds at 15 mohs. The addition of titanium dioxide (Titania) provides ductility to the composition to produce a coating capable of taking a high polish which is tough without being brittle, hard and extremely wear resistant in addition to its resistance against attack by marine life or galvanic corrosion.

The coating is very dense and exhibits little evidence of through porosity when sprayed 0.25–0.38 milimeters thick. Bond strength with the blasted substrate is very high, although testing has shown that the interparticle bond strength produced by the spraying process to be greater than the bond to the substrate. Porosity can be reduced further by sealing.

PREFERRED EXAMPLE

Ceramic Powder Characteristics

Composition: Titanium Dioxide ($TiO_2$):13% ;
Aluminum Oxide ($Al_2O_3$: balance
Size Range: −270 mesh+15 microns −53 mesh+15 microns
Melting Point: 1840° C. (3340° F.)

Spraying and Finishing Parameters

Finish: 0.8–1.6 micron (32–64 microinches) RMS
Gas used: Nitrogen - Hydrogen
Preheat Temperature: 50° C. to 120° C.; (150° F. - 275° F.)
Thickness per Pass: 25 to 50 microns;
(0.001 to 0.002 inches)
Final Thickness: 200 microns (0.008 inch)

Coating Characteristics

Microhardness: $R_c63$
Density: 3.5 g/cm$^3$ (0.121b/i$^3$)
Weight: 0.35 kg/m$^2$/0.1 mm (0.018 lb/ft $^{2/0.001i}$)

The ceramic composition may also be selected from metal oxides, borides, nitrides, carbides, silicides and their hydrated forms, wherein metal oxides are refractory oxides selected from the following group; aluminum, titanium, beryllium, cerium, chromium, magnesium, silicon and zirconium.

Any surface exposed to seawater which can sustain surface temperatures of up to 175° C. (347° F.) can be effectively protected by the method disclosed herein including, but not limited to, propeller blades and shafts, hulls, moorings, sea chests, rudders, and water gates.

While the preferred embodiment of the invention has been described and alternate spraying compositions have been suggested, it should be understood that other processes could be devised without departing from the spirit of this invention and the scope of the appended claims.

What is claimed is:

1. A process for treating a bronze-containing surface of marine hardware to inhibit the growth of marine organisms thereon, which comprises: Bonding to said surface a layer of non-toxic protective material including the steps of:

preparing said surface by blasting with metallic grit comprising aluminum oxide pellets;

coating the surface with at least one layer of a ceramic composition of metal oxides from the group consisting of oxides and hydrates oxides of aluminum, titanium, beryllium, cerium, chromium, magnesium, silicon and zirconium, by applying said composition in molten form by thermal spraying; and polishing said coated surface to a smooth finish.

2. A process for treating a surface to inhibit the growth of marine organisms thereon, wherein:

said surface comprises marine hardware containing bronze;

said surface is prepared by blasting with a metal grit;

said metal grit comprises aluminum oxide pellets;

said process comprises:

bonding to said surface a layer of non-toxic protective material including the steps of:

preparing said surface by blasting with a metallic grit;

coating the surface with a ceramic composition of metal oxides selected from the group consisting of oxides and hydrated oxides of aluminum, titanium, beryllium, cerium, chromium, magnesium, silicon and zirconium, by applying said composition in molten form by thermal spraying; and said thermal spraying comprises applying multiple layers substantially 25 to 50 microns in thickness, in order to form a final coating thickness of not less than 200 microns; and said metal oxide composition includes titanium dioxide and aluminum oxide.

3. The process of claim 2 which further comprises finishing said coating to a coarseness of not less than 1.6 micron.

4. The process of claim 3 wherein said aluminum oxide and titanium dioxide are used in a ratio between 1 to 2 and 1 to 100 by weight.

5. The process of claim 4 wherein said composition is derived from a powder mixture having a granular size range of −270 to −53 mesh, and said composition is preheated to a temperature of 50° C. to 120° C. and melted by a plasma of nitrogen and hydrogen gases.

* * * * *